US006086689A

United States Patent [19]

Sassoulas et al.

[11] Patent Number: 6,086,689

[45] Date of Patent: Jul. 11, 2000

[54] PROCESS FOR MANUFACTURING A FOIL OF FERRITIC STAINLESS STEEL HAVING A HIGH ALUMINUM CONTENT, ALUMINUM-CONTAINING FERRITIC STAINLESS STEEL, AND CATALYST SUPPORT USEFUL FOR A MOTOR-VEHICLE EXHAUST

[75] Inventors: Herve Sassoulas, Ugine; Jean-Marc Herbelin, Albertville; Jean-Michel Hauser, Ugine; Frederic Moser, Saint Ferreol, all of France

[73] Assignee: Usinor, Puteaux, France

[21] Appl. No.: 09/033,950

[22] Filed: Mar. 2, 1998

[30] Foreign Application Priority Data

Feb. 28, 1997 [FR] France ..... 97 02396

[51] Int. Cl.[7] ..... B23K 20/04

[52] U.S. Cl. ..... 148/531; 148/534; 148/535

[58] Field of Search ..... 148/531, 534, 148/535

[56] References Cited

U.S. PATENT DOCUMENTS

| | | | |
|---|---|---|---|
| 4,414,023 | 11/1983 | Aggen et al. | 420/40 |
| 5,366,139 | 11/1994 | Jha et al. | 148/535 |
| 5,516,383 | 5/1996 | Jha et al. | 148/531 |
| 5,980,658 | 11/1999 | Sukonnik et al. | 148/531 |

FOREIGN PATENT DOCUMENTS

| | | | |
|---|---|---|---|
| 0 201 910 | 11/1986 | European Pat. Off. . | |
| 0 392 203 | 10/1990 | European Pat. Off. . | |
| 0 668 366 | 8/1995 | European Pat. Off. . | |
| 37-5710 | 6/1962 | Japan | 148/531 |

OTHER PUBLICATIONS

Database WPI, Section Ch, Week 9613, Derwent Publications Ltd., London, GB; Class L03, AN 96–124323 XP002044631 and JP 08 020 847 A (Nisshin Steel Co., Ltd.), Jan. 23, 1996.

Database WPI, Section Ch, Week 9538, Derwent Publications Ltd., London, GB; Class M23, AN 95–288650 XP002044632 and JP 07 185 839 A (Nippon Yakin Kogyo Co., Ltd), Jul. 25, 1995.

Patent Abstracts of Japan, vol. 014, No. 478 (M–1036), Oct. 18, 1990 and JP 02 192801 A (Nippon Kinzoku Kogyo KK), Jul. 30, 1995.

Patent Abstracts of Japan, vol. 097, No. 002, Feb. 28, 1997 and JP 08 277422 A (Nippon Steel Corp.), Oct. 22, 1996.

Patent Abstracts of Japan, vol. 096, No. 011, Nov. 29, 1996 and JP 08 192357 A (Nippon Steel Corporation; Shinto Kogyo KK), Jul. 30, 1996.

*Primary Examiner*—George Wyszomierski
*Attorney, Agent, or Firm*—Oblon, Spivak, McClelland, Maier & Neustadt, P.C.

[57] ABSTRACT

Process for manufacturing a foil of ferritic stainless steel having a high aluminum content, which can be used in particular for a catalyst support in a motor-vehicle exhaust, wherein a ferritic stainless steel sheet of the following composition:

0.005%<carbon<0.060%

10%<chromium<23%

0.1%<aluminum<3%

0.003%<nitrogen<0.030%

0.1%<manganese<2%

0.1%<silicon<2% rare-earth elements in a proportion of between 0.03% and 0.15%, is subjected to:

plating between two sheets of aluminum in order to obtain a laminate, rolling the laminate to a thickness of 0.03–0.25 mm to form a foil, static diffusion annealing the foil in a hydrogen atmosphere, and finish rolling greater than 20%.

10 Claims, 3 Drawing Sheets

PROCESS FOR MANUFACTURING A FOIL OF FERRITIC STAINLESS STEEL HAVING A HIGH ALUMINUM CONTENT, ALUMINUM-CONTAINING FERRITIC STAINLESS STEEL, AND CATALYST SUPPORT USEFUL FOR A MOTOR-VEHICLE EXHAUST

BACKGROUND OF THE INVENTION

Field of the Invention

The present invention relates to a process for manufacturing a foil of ferritic stainless steel having a high aluminum content, the steel so produced, and the use of this steel as a catalyst support in, for example, a motor-vehicle exhaust system.

DISCUSSION OF THE BACKGROUND

In the manufacture of catalytic converters placed in, for example, a motor-vehicle exhaust line, two types of materials are used for producing the mechanical support for the catalyst compounds: ceramics or metals. The metals selection is concentrated on iron-based alloys containing chromium and aluminum in their composition. The alloy must form alumina during oxidation in the temperature range lying between 700° C. and 1200° C. In addition, the foil must contain enough aluminum to form alumina throughout the period of use, when hot, of the catalyst support.

An alloy of the Fe-20%Cr-5%Al type, produced directly by casting in a steelworks, is known. The conversion of steel sheets produced from this alloy poses problems in the field of cold-rolling, in particular because of their brittle behavior. In addition, it is difficult to exceed an aluminum content of more than 5.5% in the steel composition because of an increase in brittleness of the strips of steel sheet obtained.

A process is also known for co-rolling aluminum with a stainless steel sheet, in which a stainless steel strip is cold-plated on each side with two sheets of aluminum, the laminate obtained is rolled and then the laminate is annealed so as to cause diffusion of the aluminum into the steel strip.

SUMMARY OF THE INVENTION

One object of the invention is to provide a process for manufacturing a foil of ferritic stainless steel having a high aluminum content, which can be used as a catalyst support in a motor-vehicle exhaust, ensuring that the foil has a high aluminum content and that the surface finish is conducive to its use in a catalytic-type exhaust line.

The main subject of the invention thus is a process in which a strip of ferritic stainless steel sheet is cold-plated on each side thereof with a sheet of aluminum, the resulting three-layer laminate obtained is rolled, and the laminate is annealed so as to cause diffusion of the aluminum. In the invention the ferritic stainless steel sheet comprises the following elements, where percentages are based on total weight:

0.005%<carbon<0.060%

10%<chromium<23%

0.1%<aluminum<3%

0.003%<nitrogen<0.030%

0.1%<manganese<2%

0.1%<silicon<2% iron rare-earth elements in a proportion of between 0.03% and 0.15%. This sheet is preferably hot-rolled and cold-rolled down to a thickness of less than or equal to 1.5 mm, and subjected to:

a softening annealing treatment at a temperature of between 600° C. and 1200° C., plating between two sheets of aluminum, the sum of the thicknesses of which is between 0.05 times and 0.32 times the thickness of the strip of steel sheet, in order to obtain a three-layer laminate, rolling of the laminate to a thickness of between 0.05 mm and 0.25 mm, in order to form a foil, a static diffusion annealing treatment of the foil in a controlled hydrogen atmosphere having a dew point below −30° C. and final rolling of the foil with a total degree of reduction of greater than 20%, preferably ensuring that the final roughness Ra is less than 0.25 μm.

Other characteristics of the invention are, singly and in any combination:

the process furthermore includes a continuous final softening annealing treatment at a temperature of between 600° C. and 1200° C., the aluminum and nitrogen contents of the steel satisfy the following relationship:

$$\%Al>2\times(\%N)+0.030,$$

the sum of the contents of the elements titanium, zirconium and niobium in the steel satisfies the following relationship: $\%Ti+(\%Zr+\%Nb)\times(48/93)<0.050\%$, the steel includes from 15% to 19% of chromium in its composition, the composition of the steel includes less than 1% of copper, the composition of the steel includes less than 1% of nickel, the composition of the steel includes less than 0.5% of molybdenum, the steel includes from 0.1% to 0.5% of aluminum in its composition, the continuous final softening annealing is carried out within a temperature interval of between 800° C. and 1000° C.

The invention also relates to a ferritic stainless steel having a high aluminum content, which can be used in particular for a catalyst support such as that used in a motor-vehicle exhaust, obtained by the invention process, which includes from 4.5% to 10% of aluminum in its composition and has a surface finish with a roughness of less than 0.25 μm and preferably less than 0.1 μm.

The invention also relates to a ribbon of ferritic stainless steel having a high aluminum content, which can be used in particular in the field of electrical resistors, obtained by the invention process, which has a resistivity of greater than 1.4 μΩ.m.

BRIEF DESCRIPTION OF THE DRAWINGS

The description which follows and the appended figures, all given by way of nonlimiting example, will make the invention clearly understood.

Figure 1:
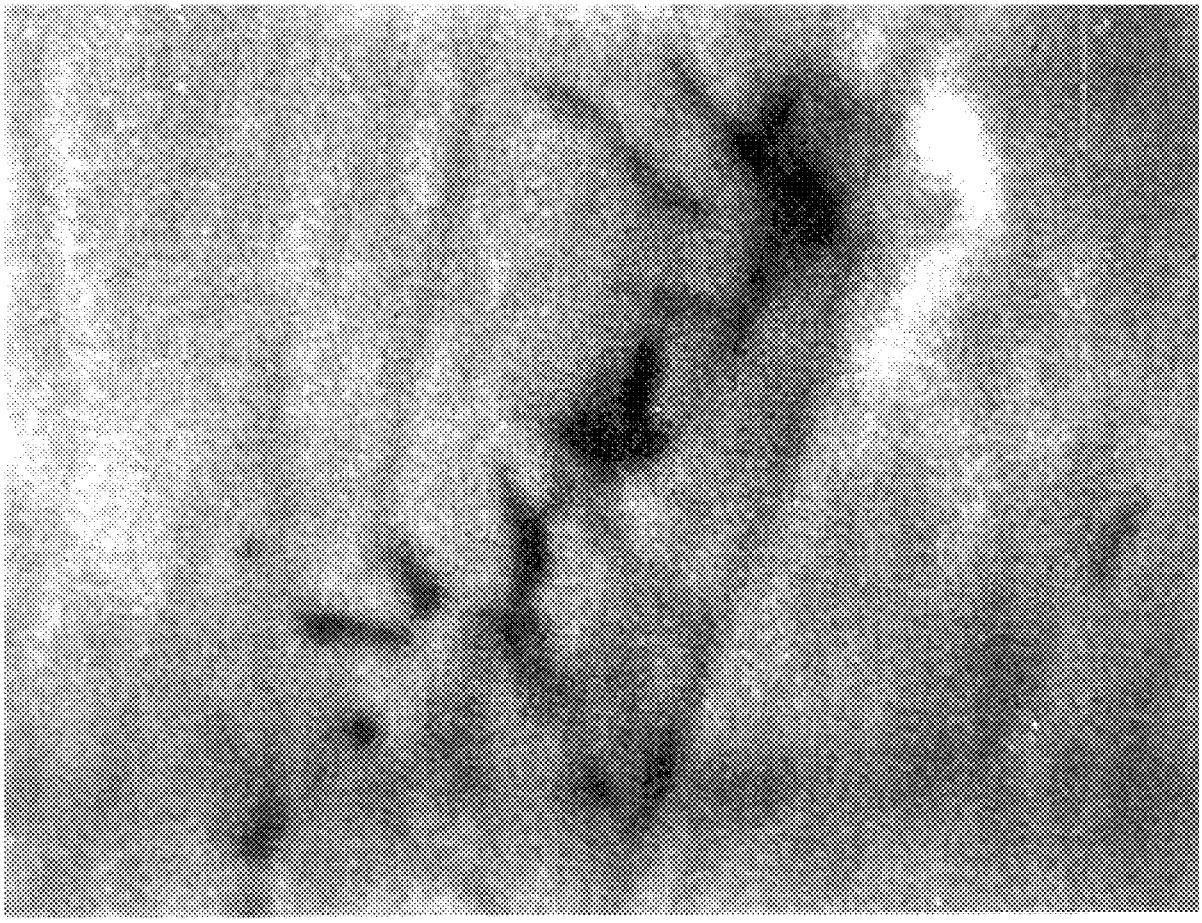
FIG. 1 is a photograph showing the formation of aluminum nitrides at a steel-aluminum interface of the laminate when the steel does not contain a defined proportion of aluminum in its composition.

The process according to the invention relates to the manufacture of a foil of ferritic stainless steel having a high aluminum content, which can be used in particular for a catalyst support such as that found in a motor-vehicle exhaust, in which a rolled stainless steel strip preferably having a thickness of less than or equal to 1.5 mm, preferably less than or equal to 0.5 mm, comprising the following elements where percentages are based on total weight:

0.005%<carbon<0.060%

10%<chromium<23%

0.1%<aluminum<3%

0.003%<nitrogen<0.030%

0.1%<manganese<2%

0.1%<silicon<2% iron rare-earth elements in a proportion of between 0.03% and 0.15%, is plated in order to obtain a three-layer laminate, the plating being carried out by placing a sheet of aluminum on each side of the strip of steel sheet. The sum of the thicknesses of the two sheets of aluminum is between 0.05 times and 0.32 times, including 0.08, 0.1, 0.15, 0.2, 0.25 and 0.3 times, the thickness of the strip of steel sheet.

The laminate obtained is rolled in order to obtain a foil, and the foil is annealed so as to cause diffusion of the aluminum, the diffusion annealing being a static annealing treatment in a controlled hydrogen atmosphere having a dew point below −30° C.

The stainless steel sheet used for plating with aluminum is a stainless steel which preferably does not contain titanium, zirconium or niobium. According to the invention, the base strip of steel sheet has a chromium content of less than 23% and an amount of aluminum of between 0.1% and 3% and preferably a chromium content of between 15% and 19% including 16, 17 and 18%. In this form, the conversion of the strip of steel sheet is greatly improved, compared to the conversion of a steel sheet containing approximately 20%, or more, of chromium. This is because the conversion of a strip of steel sheet containing no stabilizer of the titanium, zirconium or niobium type and having a chromium content of greater than approximately 19% becomes difficult because of the embrittlement due to the chromium carbonitrides in the steel of the strip.

The aluminum content of the foil obtained is between 4.5% and 10%. This corresponds to an aluminum concentration in the strip of steel sheet which is greater than can be obtained using the process of direct production by casting the steel in a steelworks.

It has been noticed that the presence of titanium, zirconium or niobium in the sheet steel is deleterious to the properties of the foil when used as a catalyst support, in particular in the context of in-service behavior when subjected to thermal stresses measured in the context of elongation and of oxidation. Likewise, alloying elements, such as molybdenum for example, form with oxygen an oxide of the $MoO_3$ type which is volatile at temperatures of the order of 1000° C. This impairs the cohesion of the oxide layer on the surface of the foil. For this, the content of molybdenum contained in the steel composition is preferably intentionally limited to less than 0.5%. Moreover, the presence of at least 0.1% of aluminum in the steel composition itself before lamination allows introduction into the liquid metal of rare earths in metallic form, without excessive formation of rare-earth oxides.

In addition, aluminum traps the nitrogen contained in the steel of the strip before and during the diffusion annealing operation. This is because it has been noticed in the case of a steel sheet containing no aluminum in its composition that the nitrogen in said steel diffuses toward the interface of the laminate where it combines with the aluminum of the sheets intended for diffusion of aluminum into the steel. At the interface, it forms a layer of aluminum nitride which is a source of embrittlement, as illustrated by the photograph in FIG. 1.

When the steel of the strip of steel sheet contains, in its composition, aluminum contents lying within the interval according to the invention, the nitrogen in the steel is fixed by the aluminum in said steel in a homogeneous manner in the form of fine precipitates and the diffusion of nitrogen to the interfaces is completely prevented.

According to the invention, the aluminum and nitrogen contents of the steel of the strip of steel sheet preferably satisfy the following relationship:

$$\%Al>2\times(\%N)+0.30.$$

The use of a strip of stainless steel sheet containing aluminum facilitates diffusion of the aluminum from the plated sheets. Because of the presence of aluminum in the steel of the steel sheet, the aluminum content after diffusion is more homogeneous between the core and the surface of the foil. The reserve of aluminum in the foil is increased.

The controlled hydrogen atmosphere in the diffusion furnace is necessary as the presence of nitrogen causes the formation of aluminum nitrides in the foil which are deleterious to the mechanical properties of said foil. A hydrogen atmosphere having a dew point below −30° C. promotes the formation of an unoxidized metal and makes rolling of the foil possible.

The diffusion annealing, which is necessarily static, is preferably carried out under a bell since the temperature hold time must be sufficiently long. This causes, in particular, slow cooling in the internal part of the coils of foil and therefore embrittlement of said foil at 475° C.

During the diffusion annealing, the roughness Ra of the foil is increased to a value of about one micrometer.

According to the invention, the foil preferably undergoes finish rolling which ensures that the final roughness Ra is less than 0.25 $\mu$m and preferably less than or equal to 0.1 $\mu$m, the finish rolling preferably being followed by a continuous final annealing treatment.

The smooth surface finish, favorable to the properties when used in a catalytic converter, may be obtained by cold-rolling the foil after the diffusion annealing, the degree of cold-rolling reduction being greater than 20%, using polished rolling-mill rolls for the last two rolling passes.

The final annealing carried out between 700° C. and 1200° C., and preferably between 800° C. and 1000° C., is a continuous annealing treatment followed by rapid cooling at a cooling rate of greater than 25° C. per second. This annealing makes it possible to eliminate the brittleness of the metal created during the diffusion annealing.

The finish of the foil obtained according to the process of the invention, made smooth during the last passes of the finish rolling and having a suitable roughness, of preferably less than 0.1 $\mu$m, makes it possible to obtain excellent in-service behavior in terms of elongation and a finish which facilitates the brazing operations. Unoxidized metal appears in fact on the surface during the rolling.

EXAMPLES

In an illustrative embodiment of the invention, the strip of steel sheet containing in its composition, by weight based on total weight:

iron carbon=0.045% chromium=16.36% aluminum=0.18% nitrogen=0.02% manganese=0.48% silicon=0.47% sulfur=0.0006% phosphorus=0.027% molybdenum=0.016% nickel=0.16% copper=0.110% titanium+zirconium+niobium=0.001% and satisfying the relationship: %Ti+(%Zr+%Nb)×(48/93) <0.050%, and rare-earth elements, cerium and lanthanum, in a proportion of 0.035%, is hot-rolled and cold-rolled to a thickness of 0.5 mm. After softening annealing, the stainless steel sheet is plated with two sheets of aluminum of food-grade quality having a thickness of 50 μm, followed by re-rolling down to a thickness of 0.2 mm. The foil obtained is then subjected to a diffusion annealing treatment at 900° C. for 15 hours, in a closed box in an atmosphere of pure hydrogen having a dew point below −30° C.

Next, the foil is rolled to a final thickness of 50 μm with a degree of reduction of 75% and a surface finish whose roughness has a final Ra of 0.08 μm. The rolling is then followed by a continuous final annealing operation, carried out on the run, at 950° C. for 40 seconds in a hydrogen atmosphere. The various operations in the process described make it possible to obtain the foil tested at temperature, the elongation of which is shown in FIG. 2.

Figure 2:
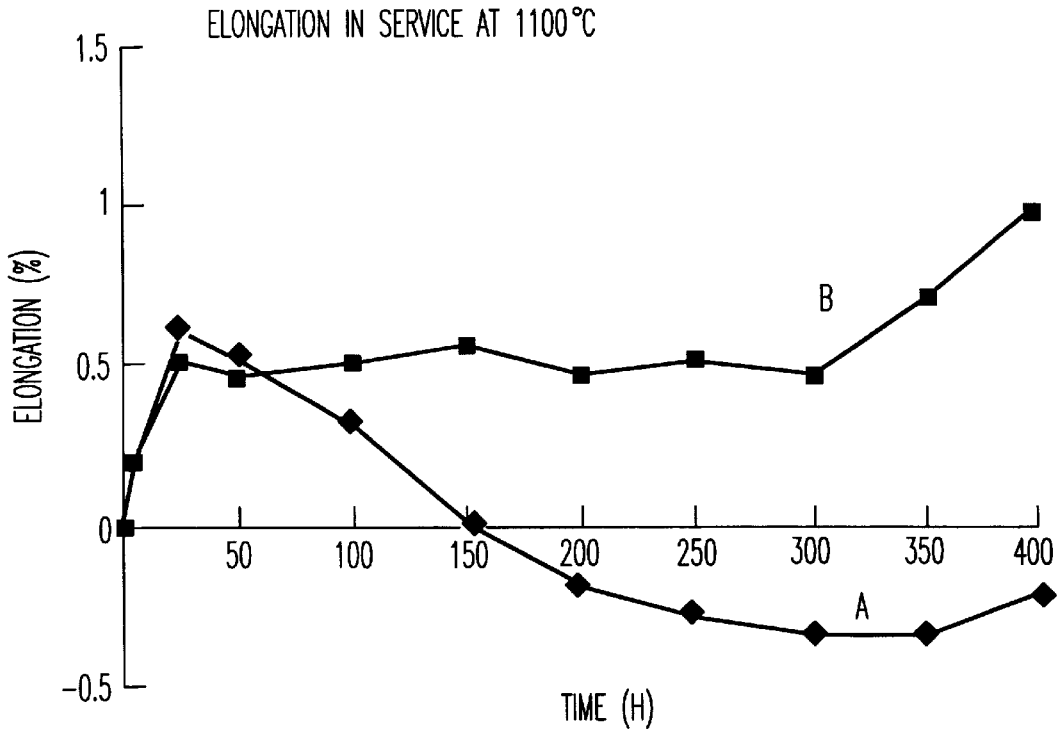
FIG. 2 shows an elongation characteristic in service when subjected to thermal stresses as a function of the hot-use time of a foil A according to the invention and of a foil B of the 20% Cr-5%Al type of a steel produced in a steelworks.

The foil according to the invention has an elongation characteristic when subjected to thermal stress in service as a function of the hot-use time, shown by curve A in FIG. 2, which is particularly improved compared with an elongation characteristic of a reference foil of the 20% Cr-5%Al type of a steel produced in a steelworks and shown by curve B.

Figure 3:
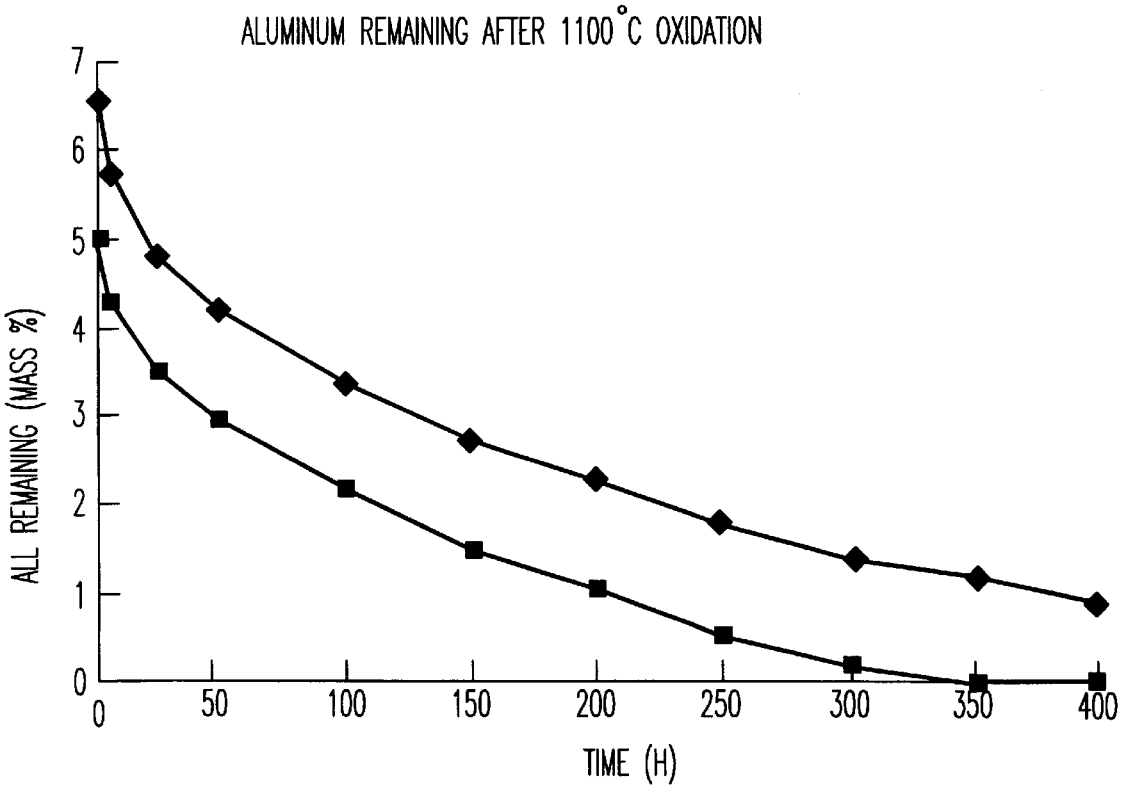
FIG. 3 shows the change in the aluminum content during hot use in a foil A according to the invention and a foil B of the 20%Cr-5%Al type of a steel produced in a steelworks.

FIG. 3 shows the change in the aluminum content, during hot use, in the composition of a foil A according to the invention and in the composition of a reference foil B of the 20%Cr-5%Al type of a steel produced in a steelworks.

Figure 4:
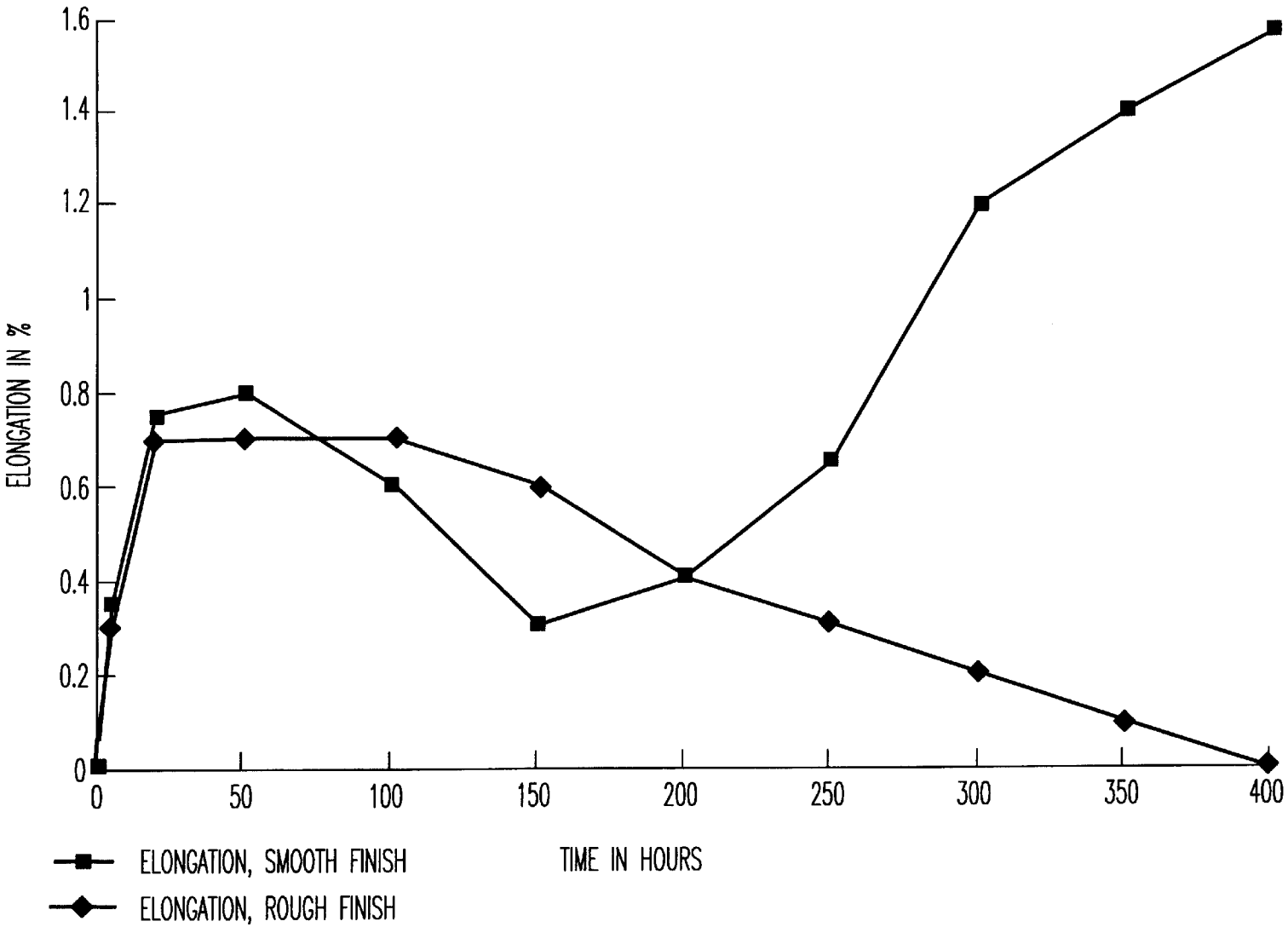
FIG. 4 shows an elongation characteristic of a foil according to the invention and an elongation characteristic of the rough foil which has not undergone rolling after the diffusion annealing.

FIG. 4 shows an elongation characteristic of a foil according to the invention and an elongation characteristic of the foil which has not undergone rolling after the diffusion annealing.

French patent application 97 02396 is incorporated herein by reference.

What is claimed as new and is desired to be secured by Letters Patent of the United States is:

1. A process for manufacturing a foil of ferritic stainless steel having an aluminum content, comprising hot rolling and cold rolling a ferritic stainless steel sheet having a composition comprising:

iron 0.005%<carbon<0.060%

10%<chromium<23%

0.1%<aluminum<3%

0.003%<nitrogen<0.030%

0.1%<manganese<2%

0.1%<silicon<2% rare-earth elements in a proportion of between 0.03% and 0.15%, to a thickness of less than or equal to 1.5 mm, and then subjecting said steel sheet to the following treatments in the following order:

a softening annealing treatment at a temperature of between 600° C. and 1200° C., plating between two sheets of aluminum, the sum of the thicknesses of which is between 0.03 times and 0.32 times the thickness of the steel sheet, in order to obtain a three-layer laminate, rolling of the laminate to a thickness of between 0.05 mm and 0.25 mm, in order to form a foil, static diffusion annealing of the foil in a hydrogen atmosphere having a dew point below −30° C., and finish rolling the foil with a total degree of reduction of greater than 20%, such that the final roughness Ra of the foil is less than 0.25 μm.

2. The process as claimed in claim 1, further comprising as a final treatment continuous final softening annealing of the finish rolled foil at a temperature of between 600° C. and 1200° C.

3. The process as claimed in claim 2, wherein the continuous final softening annealing is carried out at a temperature of 800° C. to 1000° C.

4. The process as claimed in claim 1, wherein the aluminum content and the nitrogen content of the ferritic steel sheet satisfy the following relationship: %Al>2×(%N)+0.30.

5. The process as claimed in claim 1, wherein the sum of the contents of the elements titanium, zirconium and niobium in the steel sheet satisfies the following relationship: %Ti+(%Zr+%Nb)×(48/93)<0.050%.

6. The process as claimed in claim 1, wherein the steel sheet comprises 15% to 19% chromium.

7. The process as claimed in claim 1, wherein the steel sheet comprises less than 1% copper.

8. The process as claimed in claim 1, wherein the steel sheet comprises less than 1% nickel.

9. The process as claimed in claim 1, wherein the steel sheet comprises less than 0.5% molybdenum.

10. The process as claimed in claim 1, wherein the steel sheet comprises 0.1% to 0.5% aluminum.

* * * * *